US007328826B2

(12) United States Patent
Shkolnikov

(10) Patent No.: US 7,328,826 B2
(45) Date of Patent: Feb. 12, 2008

(54) POWER NAILER WITH DRIVER BLADE BLOCKING MECHANISM MAGAZINE

(75) Inventor: Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/091,646

(22) Filed: Mar. 28, 2005

(65) Prior Publication Data

US 2006/0213946 A1 Sep. 28, 2006

(51) Int. Cl.
*B25C 1/04* (2006.01)

(52) U.S. Cl. ..... 227/8; 227/120; 227/123; 227/130

(58) Field of Classification Search ..... 227/8, 227/120, 130, 123
See application file for complete search history.

(56) References Cited

U.S. PATENT DOCUMENTS

| | | | | |
|---|---|---|---|---|
| 3,606,128 | A | 9/1971 | Cast et al. | |
| 4,197,974 | A * | 4/1980 | Morton et al. | 227/8 |
| 4,463,888 | A | 8/1984 | Geist et al. | |
| 4,597,517 | A | 7/1986 | Wagdy | |
| 4,809,898 | A | 3/1989 | Gassner et al. | |
| 4,932,580 | A | 6/1990 | Pfister et al. | |
| 5,180,091 | A | 1/1993 | Ota | |
| 5,220,123 | A | 6/1993 | Oehry | |
| 5,593,079 | A | 1/1997 | Mukoyama et al. | |
| 5,662,257 | A * | 9/1997 | Mukoyama et al. | 227/8 |
| 5,683,024 | A | 11/1997 | Eminger et al. | |
| 5,816,468 | A * | 10/1998 | Yang | 227/8 |
| 5,829,661 | A | 11/1998 | Hirtl et al. | |
| 6,036,072 | A | 3/2000 | Lee | |
| 6,056,181 | A | 5/2000 | Chuang | |
| 6,149,046 | A | 11/2000 | Ho et al. | |
| 6,199,739 | B1 | 3/2001 | Mukoyama et al. | |
| 6,209,770 | B1 | 4/2001 | Perra | |
| 6,267,284 | B1 | 7/2001 | Clark | |
| 6,592,014 | B2 | 7/2003 | Smolinski | |
| 6,641,022 | B2 * | 11/2003 | Hamano et al. | 227/120 |
| 7,000,294 | B2 * | 2/2006 | Kakuda et al. | 227/120 |
| 7,021,511 | B2 * | 4/2006 | Popovich et al. | 227/8 |
| 2003/0121948 | A1 | 7/2003 | Hsien | |
| 2004/0050897 | A1 | 3/2004 | Popovich et al. | |

FOREIGN PATENT DOCUMENTS

| | | |
|---|---|---|
| EP | 0 670 200 A1 | 2/1995 |
| EP | 0 893 205 B1 | 2/2004 |

* cited by examiner

*Primary Examiner*—Rinaldi I. Rada
*Assistant Examiner*—Michelle Lopez
(74) *Attorney, Agent, or Firm*—Greer, Burns & Crain, Ltd.; Lisa M. Soltis; Mark W. Croll

(57) ABSTRACT

In a fastener-driving tool with a magazine, a nosepiece, and a driver blade slidably reciprocating relative to the nosepiece for driving fasteners, a mechanism for preventing jamming includes a follower slidably disposed inside the magazine for urging fasteners toward the nosepiece, and having a formation for engaging the driver blade and preventing driver blade reciprocation after the last fastener in the magazine has been driven.

10 Claims, 3 Drawing Sheets

POWER NAILER WITH DRIVER BLADE BLOCKING MECHANISM MAGAZINE

BACKGROUND OF THE INVENTION

The present invention relates to fastener-driving tools, also known as power nailers, which are typically powered by combustion, pneumatics, electricity, are powder-activated or otherwise powered. In such tools, a plurality of fasteners are sequentially arranged in a magazine and are urged by a biased follower toward a driving end of the magazine where the fasteners are each pushed into a nosepiece. Once in the nosepiece, the fasteners are driven into a workpiece by a reciprocating driver blade.

A design criterion of most such tools is that the tool should be disabled when the magazine is empty of fasteners. So-called "dry firing" or "blank firing" generates significant stresses in the tool and can damage the workpiece or the tool itself. Indicator mechanisms are known in such tools to indicate to the user when the magazine is empty or almost empty, so that the magazine can be refilled prior to a dry firing condition. In some of these known mechanisms, once a magazine follower reaches a preset point where a relatively few fasteners remain in the magazine, the tool is disabled by locking a workpiece contact element to prevent dry firing.

While the prevention of dry firing is common to many types of fastener-driving tools, it is particularly challenging when the fasteners are finish nails, which typically are provided in stamped strips. The problems associated with driving such fasteners are described in commonly assigned U.S. Pat. No. 6,176,412 which is incorporated by reference. Each fastener is relatively thin, and this reduced thickness results in a relatively small increment of movement of the follower upon the driving of each fastener. Thus, it is difficult to design a tool using such fasteners to effectively alert the user when the magazine needs refilling.

A related design problem is that visual indicator systems for preventing dry firing require attention by the operator for effectiveness. If the user is understandably preoccupied with driving fasteners, the status of the magazine may be overlooked, resulting in a dry firing situation due to an empty magazine. In some cases, audible warning systems may also be overlooked when the user is concentrating on fastener application.

A related design issue is that in some cases, leftover fastener strip segments are prone to "tumble" or become misaligned within the magazine. Such segments can cause the tool to jam, especially in applications where the nail follower or pusher in the magazine fails to strongly urge the fasteners toward the nosepiece. This problem is especially severe when plastic collated fasteners are used. Since the plastic collation media is relatively brittle, the tendency is for the fasteners to become detached from the media and tumble around inside the magazine.

Thus, there is a need for providing a power nail feeding mechanism for a fastener-driving tool which prevents the tumbling or misalignment of fastener strip segments within the magazine. There is also a need for providing a power nail feeding mechanism for such a tool which prevents jams in either the magazine or the nosepiece due to stray or misaligned fastener strip segments. There is also a need for a more effective system for preventing dry firing in fastener-driving tools.

BRIEF SUMMARY OF THE INVENTION

The above-listed objects are met or exceeded by the present magazine follower for a fastener-driving tool, wherein the follower is configured to block downward movement of the driver blade after the driving of the last fastener in a strip or in the magazine. By completely emptying the magazine before blocking tool operation, the problems created by stray or misaligned fastener strip segments and associated collating strip material are reduced.

More specifically, in a fastener-driving tool with a magazine, a nosepiece, and a driver blade slidably reciprocating relative to the nosepiece for driving fasteners, a mechanism for preventing jamming includes a follower slidably disposed inside the magazine for urging fasteners toward the nosepiece, and having a formation for engaging the driver blade and preventing driver blade reciprocation after the last fastener in the magazine has been driven.

In another embodiment, a fastener-driving tool includes a magazine having a first end for receiving fasteners, a second end for delivering fasteners for driving, and a guide channel. A nosepiece defines a fastener passage slot in communication with the magazine for receiving fasteners from the second end, and a driver blade path in communication with the slot. A driver blade slidably reciprocates in the driver blade path for driving fasteners. A follower is slidably disposed inside the magazine and has a first portion for urging fasteners toward the nosepiece and a second portion for engaging the driver blade and preventing driver blade reciprocation after the last fastener in a fastener strip has been driven.

DETAILED DESCRIPTION OF THE INVENTION

Figure 1:
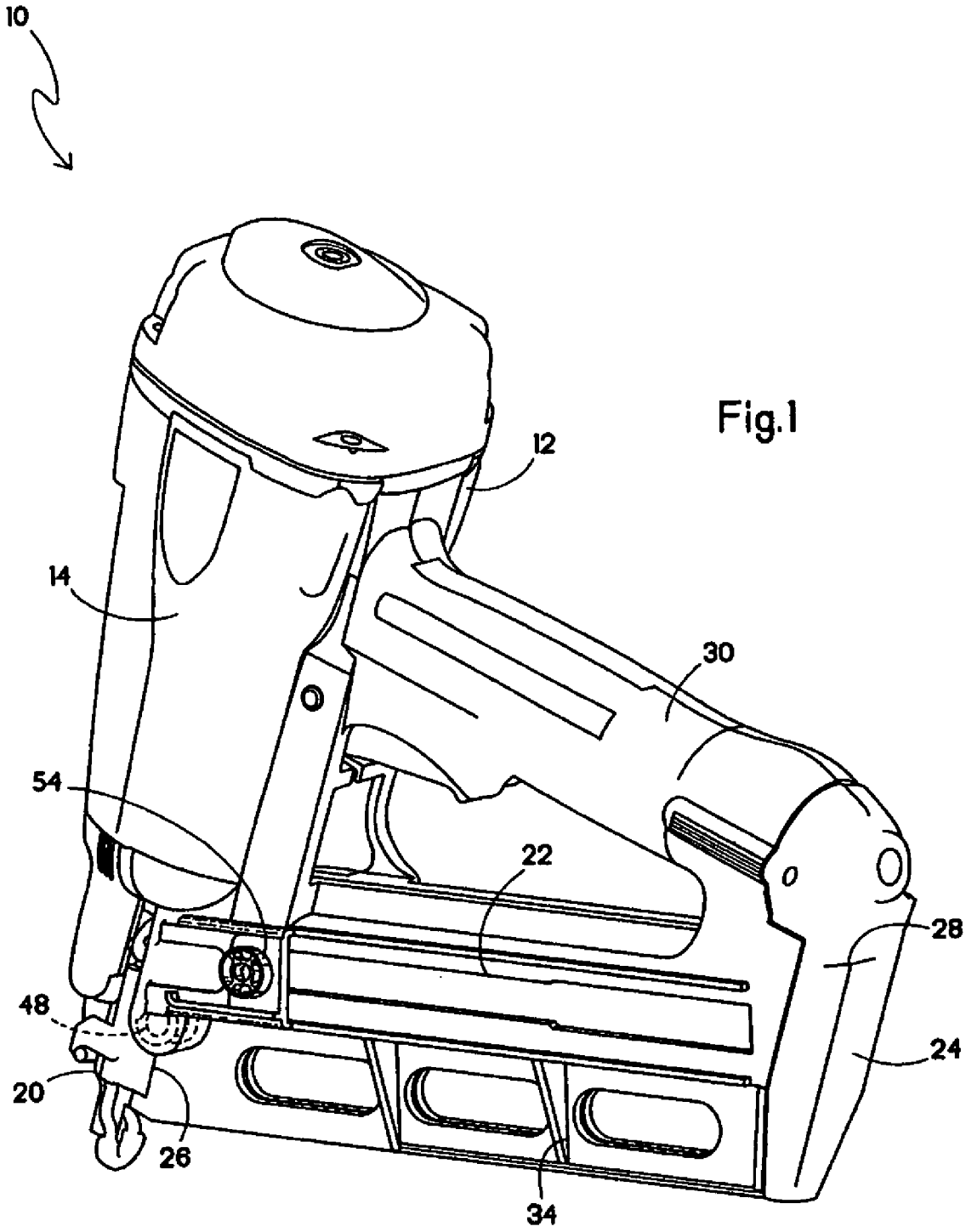
FIG. 1 is a rear perspective elevation of a fastener-driving tool of the type which is suitable for use with the present invention.
Figure 2:
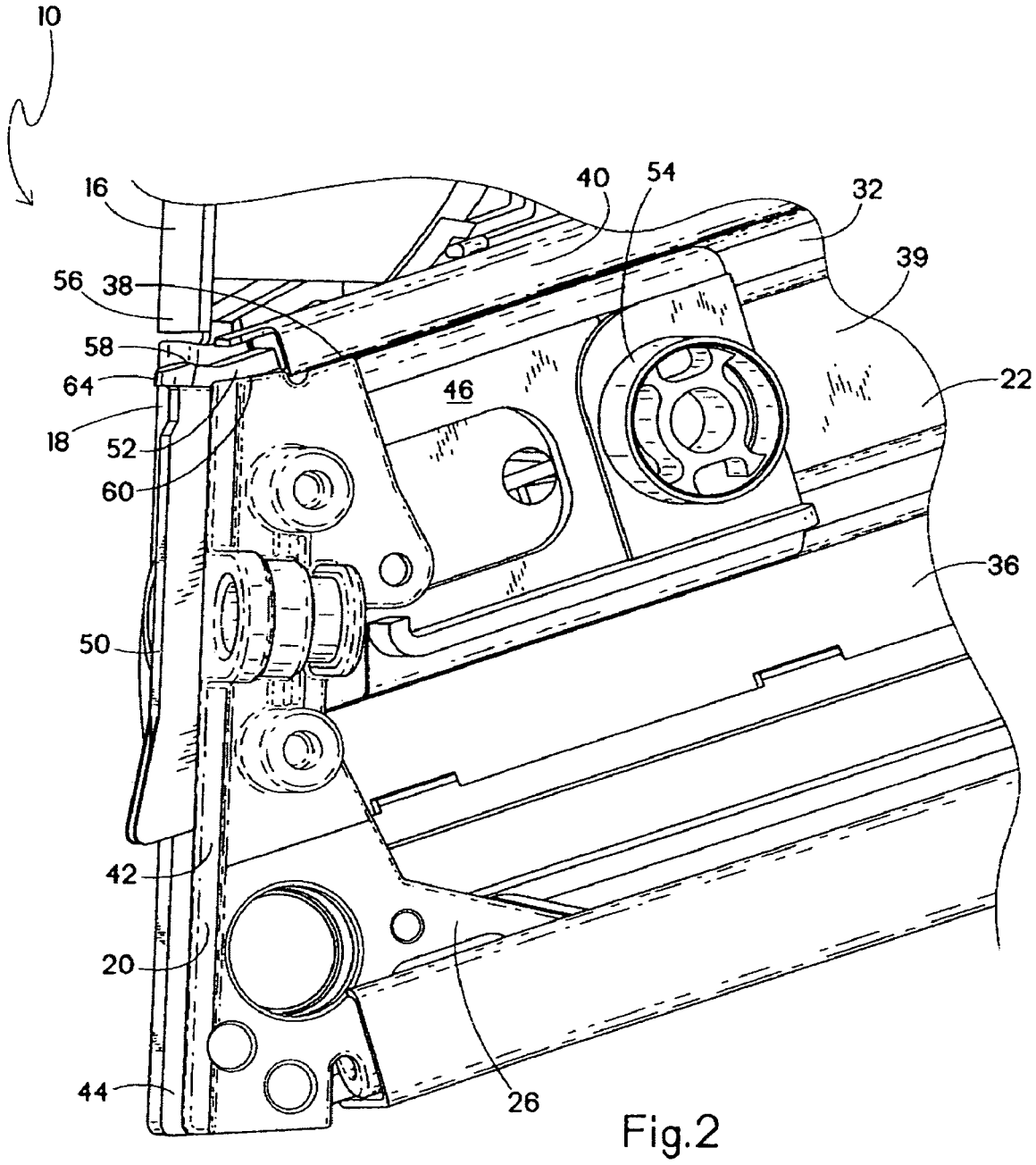
FIG. 2 is an enlarged, fragmentary side elevation of the tool shown in FIG. 1 with portions omitted for clarity.

Referring now to FIGS. 1 and 2, a fastener-driving tool suitable for use with the present lockout mechanism is generally designated 10. While the tool 10 is depicted as a pneumatic tool, it is contemplated that the present mechanism may also be utilized with combustion-powered, powder, electric-powered, or any other power sources for fastener tools, provided they employ a magazine for sequentially feeding fasteners to a nosepiece or equivalent structure where they are impacted by a driver blade for driving action into a workpiece. The tool 10 includes a housing 12 enclosing a fastener driving portion 14 which includes a reciprocating driver blade 16 traveling in a driver blade path 18 in a nosepiece 20 for driving fasteners into a workpiece as is known in the art.

A magazine 22 is associated with the housing 12 and has a first or feed end 24 and a second or driving end 26, the latter closer to, and connected to the nosepiece 20 for feeding fasteners (not shown) contained within the magazine toward the driver blade path 18. As is known in the art, the fasteners are preferably provided in strips, with adjacent fasteners temporarily secured to each other with chemical adhesives, tape or plastic collator strips. A disadvantage of conventional tools is that the last few remaining fasteners in a strip, and/or collator strips or other adhesive materials often become jammed in the magazine 22 and/or the nosepiece 20.

The fasteners are inserted into the magazine 22 at the feed end 24 through a slot 28 as is well known in the art. In some tools, the slot 28 is provided in an endcap which in turn is secured to a main magazine body. A handle 30 is connected to the housing 12 between the fastener-driving portion 14 and the feed end 24 of the magazine 22. In some embodiments, the handle 30, the magazine 22 and the fastener-driving portion 14 of the housing 12 are integrally formed. It is also contemplated to have the handle 30 and the fastener-driving portion 14 integrally formed, with the magazine 22 a separate component.

Referring again to the magazine 22, a fastener track 32 is defined for enabling the passage of the fasteners toward the nosepiece 20. In a preferred embodiment, the fastener track 32 is partially defined by opposing halves 34, 36 of the magazine 22. Unitary magazines are also contemplated. An interior of an upper portion 38 the magazine 22 appears generally "T"-shaped in cross section, with a generally vertical leg 39 formed by the fastener track 32, and a generally horizontal leg 40 formed at an upper end of the fastener track, the leg 40 also referred to as a guide channel. The guide channel 40 is in communication with the vertical leg 39 and is used to slidably receive heads of the fasteners for guiding them towards the second or driving end 26 of the magazine 22. Elongate shank portions of the fasteners slide in the vertical leg 39.

Figure 3:
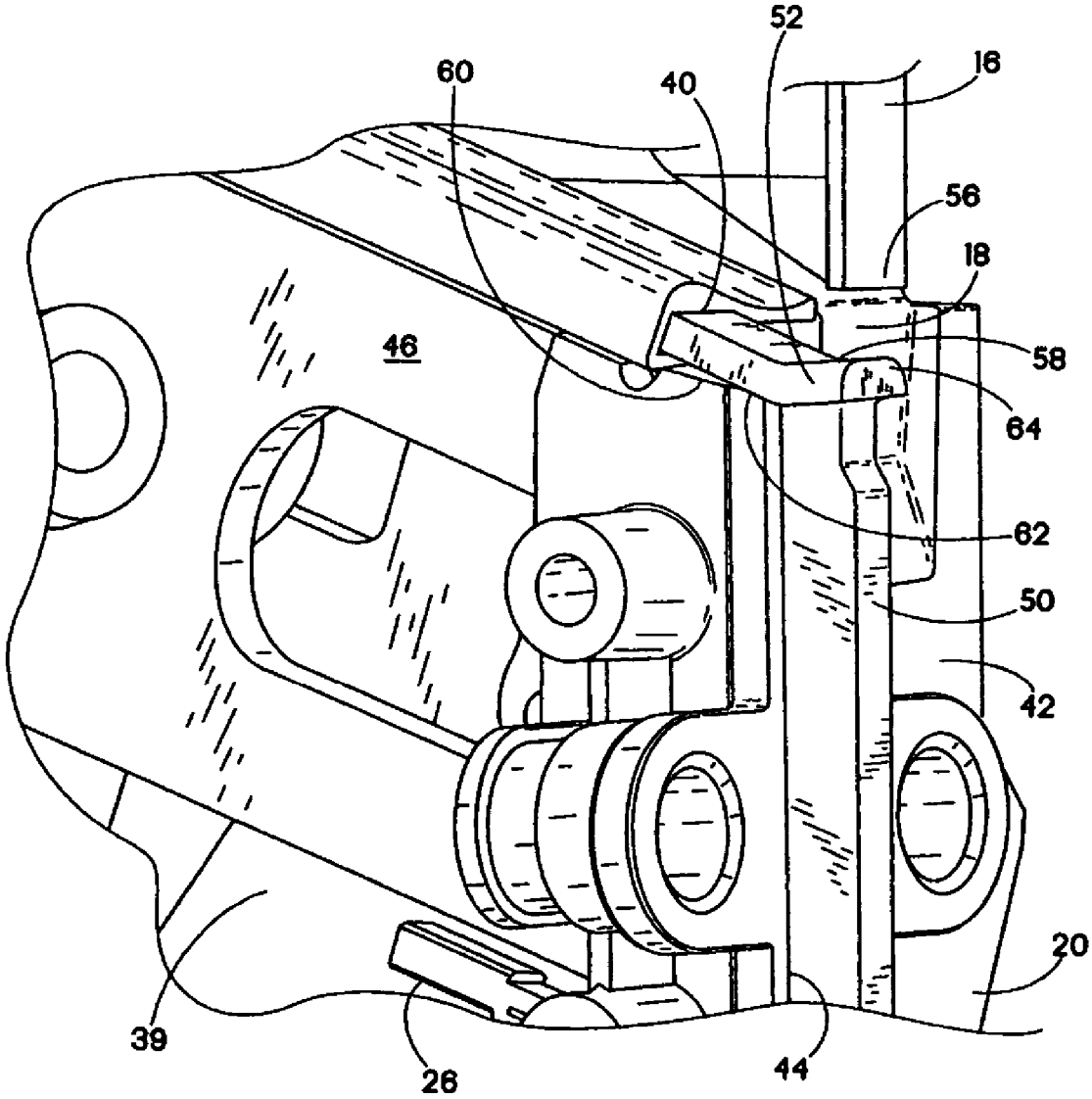
FIG. 3 is an enlarged fragmentary front perspective of the tool of FIG. 1, with portions omitted for clarity.

Referring now to FIGS. 2 and 3, the nosepiece 20 includes a shear block 42 defining a fastener passage slot 44 which is in communication with the fastener track 32 of the magazine 22, and is also in communication with driver blade path 18. Depending on the configuration of the particular tool, the nosepiece 20 and the shear block 42 may be a single compoment, or may be seperate pieces. Thus, fasteners are fed from the magazine 22, through the passage slot 44 into the driver blade path 18, where they are imapcted by the driver blade 16, which sequenially saperates each fastener from the strip as it is driven.

A follower 46 is slidably disposed in the magazine 22 and is subject to a biasing force provided by a spring 48 (shown hidden) or the like, so that the follower urges the fasteners towards the nosepiece 20, and more specifically, toward the passage slot 44. As is well known in the art, one end of the spring 48 is connected to the magazine 22.

The follower 46 includes a first or front edge portion 50 for engaging the fastener strip, and a second portion 52 for slidably engaging the guide channel 40. The second portion 52 laterally expands past respective sides of the first portion for stabilizing the sliding travel of the follower 46 in the magazine 22. As such, the follower 46 is generally "T"-shaped when viewed from the front.

A follower handle 54 is provided to the follower 46 for facilitating the pulling of the follower 46 against the force of the spring 48 toward the feed end 24. As is known in the art, a shoulder or step (not shown) is formed in the fastener track 32 for holding the follower 46 in place while fasteners are inserted into the fastener track. Other equivalent devices known in the art are contemplated for temporarily securing the follower 46 in position in the fastener track 32.

An important feature of the present mechanism for preventing jamming is that the second portion 52 of the follower 46 is also configured for engaging the driver blade 16, thus preventing driver blade reciprocation after the last fastener in a fastener strip, or the last fastener in the magazine, has been driven. In addition, the follower 46 is constructed and arranged so that the front or leading edge 50 enters the passage slot 44 when the last fastener is driven.

Referring now to FIGS. 2 and 3, it will be seen that the driver blade 16 has a lower end 56. Once the driver blade 16 returns to a pre-firing position, and upon the driving of the last fastener in the magazine, the leading edge 50 of the follower 46 projects or extends into the nosepiece 20, specifically into the fastener passage slot 44, and the second portion 52 is disposed in close proximity to the driver blade's lower end 56. More specifically, the lower end 56 of the driver blade 16 is preferably disposed approximately 0.025 to 0.10 inch from an upper surface 58 of the second portion 52, and most preferably 0.05 inch from the lower end, however other spacing is contemplated depending on the situation. By providing a relatively short distance between the lower end 56 and the second portion 52, in the event the tool 10 is fired after the last fastener in the magazine has been driven, the energy of impact of the driver blade against the second portion is insignificant, and does not damage the follower 46.

The second portion 52 is slidably retained in the guide channel 40. To support the follower 46 against the impact force of the driver blade 16, the shear block 42 has an upper edge 60, and a lower edge 62 of the second portion 52 slidably engages the upper edge once the last fastener is driven. This engagement provides a back-up support for the second portion 52 against the momentum of the driver blade 16.

It will be seen that a front edge 64 of the second portion 52 extends farther into the driver blade path 18 than the first portion or leading edge 50 of the follower 46. Also, both the first and second portions 50, 52 extend into the driver blade path 18 after the last fastener in the magazine has been driven.

In operation, the follower 46 urges fasteners toward the shear block 42, where they are sequentially driven by the driver blade 16. Once the last fastener has been driven, the leading edge 50 and the second portion 52 of the follower 46 extend into the driver blade path 18, such that the second portion is in close proximity to the lower end 56 of the driver blade 16. In the event the user triggers a tool firing after the magazine 22 is empty, the lower end 56 of the driver blade 16 will impact the second portion 52, and will be prevented from further reciprocal movement. The user will then be alerted to the need for additional fasteners in the magazine 22. Once the follower 46 is retracted in the -course of reloading the magazine 22, the tool 10 will be restored to normal operating conditions.

While specific embodiments of the of the present power nailer with driver blade blocking mechanism in a magazine have been shown and described, it will be appreciated by those skilled in the art that changes and modifications may be made thereto without departing from the invention in its broader aspects and as set forth in the following claims.

What is claimed is:

1. A fastener-driving tool comprising:

a magazine;

a nosepiece having a fastener passage slot configured for receiving fasteners from said magazine and a driver blade path in communication with said slot;

a driver blade slidably reciprocating in said path; and a mechanism for preventing jamming, comprising:

a follower slidably disposed inside the magazine for urging fasteners toward the nosepiece, and having an upper surface constructed and arranged for directly receiving the driver blade and preventing driver blade entry into said path after a last fastener in the magazine has been driven, said tool thus allows tool firing and reciprocation of said driver blade when the magazine is empty, but impedes the travel of said driver blade by directly receiving said blade upon said upper surface;

said follower includes a first portion configured for engaging a fastener strip, and having a pair of sides, and a second portion including said upper surface;

said second portion extends laterally-past said sides of the first portion for guiding said follower in the magazine, said second portion forms a widest part of said follower when viewed from a front of the tool where the magazine abuts the nosepiece;

said nosepiece includes a shear block defining a fastener passage slot, and said follower is constructed and arranged to enter the slot after the last fastener is driven; and wherein said shear block has an upper edge, and said second portion slidingly engages said upper edge for supporting said laterally extending second portion against impact generated by said driver blade directly impacting said upper surface.

2. The tool of claim 1 wherein said follower is generally "T" shaped when viewed from the front.

3. The tool of claim 1 wherein said driver blade has a lower end, and in a pre-firing position, once the last fastener is driven, said follower extends into said nosepiece and said second portion is disposed in close proximity to said lower end.

4. The tool of claim 3, wherein after the last fastener is driven, said lower end of said driver blade is approximately 0.025 to 0.1 inch from said second portion.

5. A fastener-driving tool, comprising:

a magazine having a first end for receiving fasteners, a second end for delivering fasteners for driving, and a guide channel;

a nosepiece defining a fastener passage slot in communication with said magazine for receiving fasteners from said second end and a driver blade path in communication with said slot;

a driver blade slidably reciprocating in said driver blade path for driving fasteners;

a follower slidably disposed inside said magazine and having a first portion for urging fasteners toward said nosepiece and a second portion having a thickened upper surface configured for directly receiving a lower end of said driver blade and preventing driver blade entry into said driver blade path after the last fastener in a fastener strip has been driven, said tool thus allows tool firing and reciprocation of said driver blade when the magazine is empty, but impedes the travel of said driver blade by directly receiving said blade upon said upper surface;

wherein said upper surface of said second portion is displaced in a range of 0.025 to 0.10 inch from a lower end of said driver blade after the last fastener has been driven for reducing impact to said follower when said tool is fired after the last fastener in the fastener strip has been driven; and said nosepiece includes a shear block with an upper edge, and said second portion laterally extends from sides of said first portion and slidably engages said upper edge for supporting said laterally extending second portion against impact generated by operational movement of said driver blade.

6. The tool of claim 5 wherein said second portion is slidably engaged in said guide channel, and has a front edge extending beyond a leading edge of said first portion.

7. The tool of claim 5 wherein said first portion of said follower is aligned with said slot in said nosepiece and extends into said driver blade path after the last fastener has been driven.

8. The tool of claim 5 wherein said second portion is supported in said guide channel and receives a lower end of said driver blade for preventing further linear reciprocation after the last fastener has been driven.

9. A fastener-driving tool, comprising:

a magazine having a first end for receiving fasteners, a second end for delivering fasteners for driving, and a guide channel;

a nosepiece including a shear block defining a fastener passage slot in communication with said magazine for receiving fasteners from said second end and a driver blade path in communication with said slot;

a driver blade slidably reciprocating in said driver blade path for driving fasteners;

a follower slidably disposed inside said magazine and having a first portion for urging fasteners toward said nosepiece and a second portion with a thickened upper surface configured for directly receiving said driver blade and preventing driver blade entry into said driver blade path after the last fastener in a fastener strip has been driven, said tool thus allows tool firing and reciprocation of said driver blade when the magazine is empty, but impedes the travel of said driver blade by directly receiving said blade upon said upper surface;

said driver blade has a lower end, and in a pre-firing position, once the last fastener is driven, said follower extends into said nosepiece and said upper surface of said second portion is disposed in close proximity to said lower end; and said shear block has an upper edge, and wherein said second portion laterally extends from sides of said first portion and slidingly engages said upper edge for supporting said second portion against movement of said driver blade for reducing impact to said follower when said tool is fired after the last fastener in the fastener strip has been driven.

10. The tool of claim 9, wherein after the last fastener is driven, said lower end of said driver blade is approximately 0.025 to 0.1 inch from said second portion.

* * * * *